US008521149B2

(12) United States Patent
Yoon et al.

(10) Patent No.: US 8,521,149 B2
(45) Date of Patent: Aug. 27, 2013

(54) FREQUENCY CONTROL APPARATUS AND METHOD FOR RAILWAY WIRELESS COMMUNICATION

(75) Inventors: Byung Sik Yoon, Daejeon-si (KR); Sook-Jin Lee, Daejeon-si (KR)

(73) Assignee: Electronics and Telecommunications Research Institute, Daejeon-si (KR)

( * ) Notice: Subject to any disclaimer, the term of this patent is extended or adjusted under 35 U.S.C. 154(b) by 0 days.

(21) Appl. No.: 13/554,329

(22) Filed: Jul. 20, 2012

(65) Prior Publication Data

US 2013/0146719 A1 Jun. 13, 2013

(30) Foreign Application Priority Data

Dec. 8, 2011 (KR) ..... 10-2011-0131245

(51) Int. Cl.
*H04M 3/00* (2006.01)

(52) U.S. Cl.
USPC ..... 455/418; 455/419; 455/550.1; 701/19

(58) Field of Classification Search
USPC ..... 455/419, 418, 550.1; 701/19
See application file for complete search history.

(56) References Cited

U.S. PATENT DOCUMENTS

| | | | | |
|---|---|---|---|---|
| 3,662,167 | A * | 5/1972 | Elcan et al. | 246/2 F |
| 4,766,817 | A * | 8/1988 | Uozumi | 104/299 |
| 4,800,507 | A * | 1/1989 | Brown | 702/73 |
| 6,663,053 | B1 * | 12/2003 | Shams | 246/249 |
| 2004/0144896 | A1 * | 7/2004 | Shams | 246/220 |
| 2005/0107954 | A1 * | 5/2005 | Nahla | 701/301 |
| 2009/0143927 | A1 * | 6/2009 | Julich et al. | 701/19 |
| 2011/0130899 | A1 * | 6/2011 | Beaurent et al. | 701/19 |

FOREIGN PATENT DOCUMENTS

| | | |
|---|---|---|
| KR | 10-0511643 | 9/2005 |
| KR | 10-0733598 | 7/2007 |

* cited by examiner

*Primary Examiner* — Danh Le
(74) *Attorney, Agent, or Firm* — Nelson Mullins Riley & Scarborough LLP

(57) ABSTRACT

A frequency control apparatus and method for railway wireless communication are provided. The frequency control apparatus includes a variable frequency processor and a fixed frequency processor. The variable frequency processor selects an available variable frequency and wirelessly receives non-safety-related train running information from a base station at the selected variable frequency. The fixed frequency processor wirelessly receives safety-related train running information at a predetermined fixed frequency.

20 Claims, 9 Drawing Sheets

FREQUENCY CONTROL APPARATUS AND METHOD FOR RAILWAY WIRELESS COMMUNICATION

CROSS-REFERENCE TO RELATED APPLICATION

This application claims the benefit under 35 U.S.C. §119 (a) of Korean Patent Application No. 10-2011-0131245, filed on Dec. 8, 2011, the entire disclosure of which is incorporated herein by reference for all purposes.

BACKGROUND

1. Field

The following description relates to railway communication technology, and more particularly, to railway communication using wireless communication.

2. Description of the Related Art

Since railways began operating in 1830s England, various methods and apparatuses for securing the safety of trains have been developed and introduced. In communication between a train controller and an engineer or between engineers, a voice service is provided by analog or digital wireless communication equipment. However, recently, the existing railway signal equipment based on wired communication is quickly being replaced by wireless communication equipment, for reasons concerning compatibility between countries, economics, technology, etc.

A control scheme that has until now been performed via cable between ground equipment is being replaced, and control division of on-board ground equipment is being newly established from a functional perspective. Therefore, a safe and simple Communication Based Train Control (CBTC) system is being studied in various countries around the world, and has been put into practice in some countries. Also, with advancements in technology, the CBTC system is expected to be more broadly applied to railway signal systems than at present.

CBTC systems are installed on the ground and on board trains, and, by continuously performing communication therebetween, they ensure the safety of running trains. Such technology is the most advanced technology in signal control technology that has been developed to date, and shortens a running interval compared to conventional signal control systems, thus increasing a transport capacity. Also, data communication is performed between a train and a central control system so that running efficiencies of trains can be increased and the safety and convenience of railways can be optimized.

Some frequencies of the GSM band have been assigned as railway dedicated frequencies in ERTMS/ETC in Europe, and the wireless CBTC system uses GSM-R. Many countries including the USA use the IEEE 802.11.x standard of the Industrial Scientific Medical (ISM) 2.4 GHz band. Wireless communications between all CBTC systems used in Korea use the ISM 2.4 GHz band. Gimhae light rail, Metro Shinbundang line, and Yongin light rail, whose construction has been planned, as well as Metro Bundang line, plan to install a CBTC system using the ISM 2.4 GHz band.

However, in the RF-CBTC system using the 2.4 GHz band, it is difficult to ensure continuous performance due to interference caused by characteristic of the 2.4 GHz band, causing concern about possible interruption of railway operation. To overcome such limitations, there is need to secure a dedicated frequency for railway signals. Guidelines of the Korean Government advise that the ISM 2.4 GHz band cannot be used for services related to safety of life in a radio wave environment where a variety of wireless equipment is used. Moreover, technology standards of wireless equipment for businesses other than electronic communications (Notification No. 2007-80 of the Radio Research Laboratory) also state that the ISM 2.4 GHz band cannot be used to provide services related to life safety. Accordingly, when an accident occurs, a user of the frequency band may be held responsible.

In consideration of these circumstances in Korea regarding the 2.4 GHz band, interference may cause uncertainty in railway operation, and thus, for stable railway operation, there is a need to secure a railway dedicated frequency that enables safe railway traffic service and comfortable railway operation even when there is difficulty in a frequency allocation procedure and interval. In the future, railway operation will change to an unmanned driving system. To keep pace with change, as in countries with advanced rail systems, there is a need to secure frequency resources for building a railway safety system and an RF-CBTC system enabling advance preparation.

However, recently, since the amount of wireless data on the airwaves has been increasing explosively, it is not easy to assign many frequency domains for a railway dedicated frequency. In the future, demand for wireless frequency resources needed by railways is predicted to increase. However, in reality there is a limit to providing all needed frequencies in licensed frequency bands with limited frequency resources.

SUMMARY

The following description relates to an apparatus and a method for performing control such that railway control information or railway call information necessary for railway operation safety is transmitted and received in a licensed frequency band available for railways, and various passenger service information irrelevant to railway operation safety is transmitted and received in a frequency band that has been assigned but is not used at a current location or a current time.

In one general aspect, a frequency control apparatus for railway wireless communication includes: a variable frequency processor configured to select an available variable frequency and wirelessly transmit non-safety-related train running information of a train to a mobile station in the train at the selected variable frequency; and a fixed frequency processor configured to wirelessly transmit safety-related train running information to the mobile station at a predetermined fixed frequency.

In another general aspect, a frequency control apparatus for railway wireless communication includes: a variable frequency processor configured to select an available variable frequency and wirelessly receive non-safety-related train running information from a base station at the selected variable frequency; and a fixed frequency processor configured to wirelessly receive safety-related train running information at a predetermined fixed frequency.

In another general aspect, a frequency control method for railway wireless communication includes: selecting an available variable frequency and wirelessly transmitting non-safety-related train running information of a train to a mobile station in the train at the selected variable frequency; and wirelessly transmitting safety-related train running information to the mobile station at a predetermined fixed frequency.

In another general aspect, a frequency control apparatus for railway wireless communication includes: wirelessly receiving safety-related train running information from a base station at a predetermined fixed frequency; and selecting an available variable frequency and wirelessly receiving non-safety-related train running information at the selected variable frequency.

Other features and aspects will be apparent from the following detailed description, the drawings, and the claims.

Figure 1:
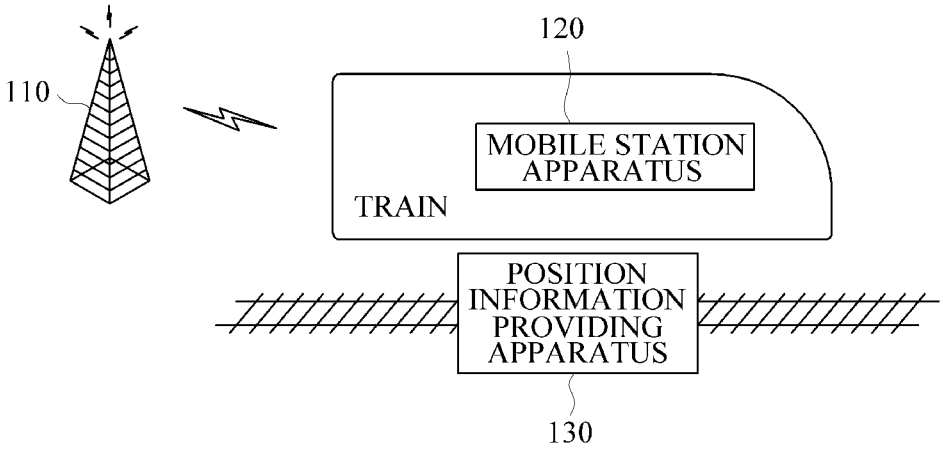
FIG. 1 is a block diagram illustrating a railway wireless communication system according to an embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Hereinafter, preferred embodiments of the present invention will be described in detail.

The present invention relates to an apparatus and a method for transmitting and receiving safety-related train running information, which directly affects railway operation safety, at a fixed frequency that has been assigned as a railway dedicated frequency, and transmitting and receiving train non-safety-related train running information at a variable frequency.

Here, the safety-related train running information (railway communication safety-related train running information: vital data) is directly relevant to stability in wireless train communication, and includes railway signal control information, call service information between a controller and an engineer, line transfer call service information, call service information between engineers, railroad periphery maintenance call service information, train crew call service information, etc. Such a communication service is required for railway operation safety, and thus has be immediately and stably provided anywhere at any time when a train is being driven.

On the other hand, the train non-safety-related train running information (railway communication non-safety-related train running information: non-vital data) is not directly related to stability in train communication, and includes train diagnosis information, passenger ticket issuing information, schedule information, reservation information, passenger Internet service information, in-train image provision service information, etc. Such information does not greatly affect railway operation safety but increases convenience for passengers and crew and the efficiency of a passenger service. This is a service that does not require continuous data transmission depending on communication line conditions, or immediate data transmission according to various conditions.

FIG. 1 is a block diagram illustrating a railway wireless communication system according to an embodiment of the present invention.

Referring to FIG. 1, the railway wireless communication system includes a base station 110 that provides train running information to a moving train, and a mobile station apparatus 120 that is disposed in a train and wirelessly receives the train running information from the base station 110. Also, according to an embodiment of the present invention, the railway wireless communication system includes a position information providing apparatus 130 that provides real-time position information to the mobile station apparatus 120.

The base station 110 transmits safety-related train running information at a fixed frequency, and transmits non-safety-related train running information at a variable frequency. The base station 110 includes a variable frequency processor that processes the non-safety-related train running information, and a fixed frequency processor that processes the safety-related train running information. The mobile station apparatus 120 receives the safety-related train running information at the fixed frequency, and receives the non-safety-related train running information at the variable frequency. The mobile station apparatus 120 includes a variable frequency processor that processes the received non-safety-related train running information, and a fixed frequency processor that processes the received safety-related train running information.

For the safe running of trains, it is very important to secure current position information of the trains, and thus, even a highly reliable receiver such as a GPS receiver is not used for obtaining position information. As a substitute, a plurality of the position information providing apparatuses 130 for guaranteeing high reliability are disposed on a railroad at certain intervals. Therefore, the mobile station apparatus 120 in a train detects train position information with the position information providing apparatus 130 (for example, Euro-Balise), and uses the train position information to safely run the train.

The present invention may have two embodiments according to the control of the variable frequency.

In a first embodiment, a method of performing control in order for a base station and a mobile station apparatus to select a predetermined available variable frequency according to the current position information of a train may be implemented.

In a second embodiment, a method may be implemented in which a base station determines a variable frequency that varies according to time and various ambient conditions, and transfers the determined variable frequency to a mobile station apparatus in order to use the variable frequency.

The detailed configurations and operations of the apparatus and method according to the above-described embodiments will be described below with reference to the accompanying drawings.

Figure 2:
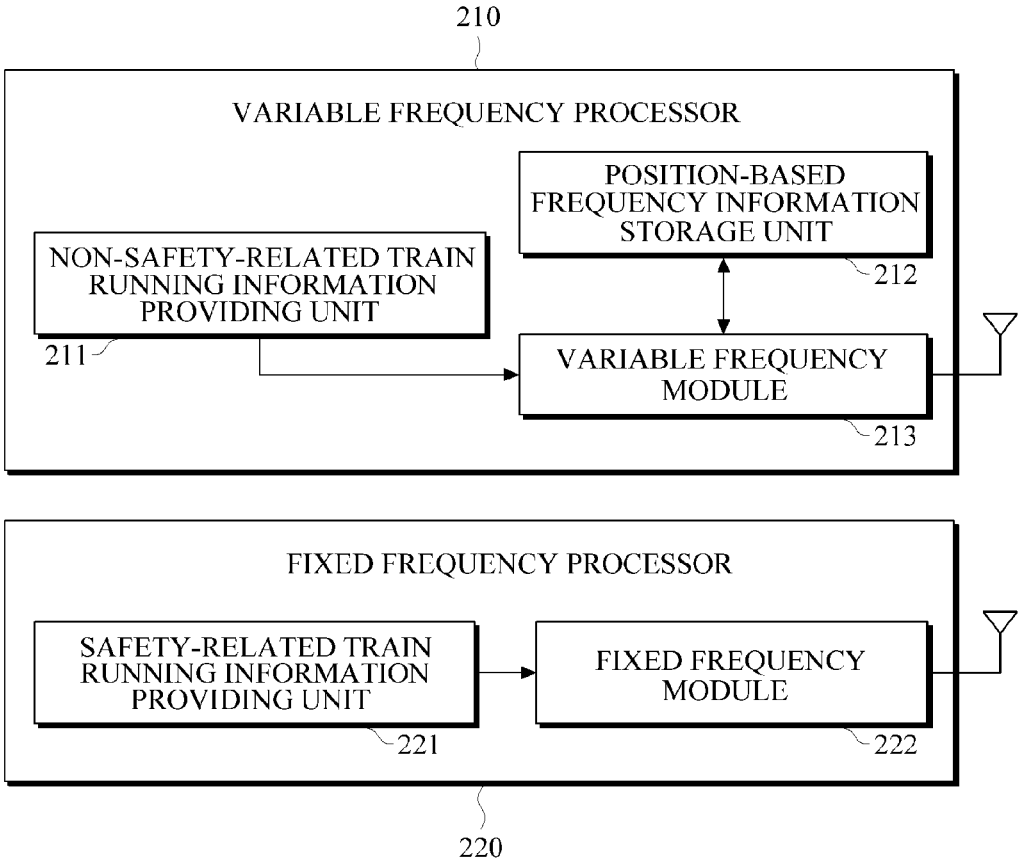
FIG. 2 is a block diagram illustrating an internal configuration of a base station apparatus for railway wireless communication according to a first embodiment of the present invention.

FIG. 2 is a block diagram illustrating an internal configuration of a base station apparatus for railway wireless communication according to a first embodiment of the present invention.

Referring to FIG. 2, a variable frequency processor 210 includes a non-safety-related train running information providing unit 211, a position-based frequency information storage unit 212, and a variable frequency module 213. A fixed frequency processor 220 includes a safety-related train running information providing unit 221 and a fixed frequency module 222.

Although not shown, the non-safety-related train running information providing unit 211 combines information input from a user through a manipulator and information received by a wired/wireless communicator to generate and output non-safety-related train running information.

The position-based frequency information storage unit 212 stores an available variable frequency information table according to a train position. Here, a representative example of the available variable frequency is a white space frequency that is not used in a specific zone but has been licensed as a broadcasting frequency.

The variable frequency module 213 obtains the position information of a specific train, and detects a variable frequency available at the obtained position of the specific train from the position-based frequency information storage unit 212. In a method of obtaining the position information of the specific train, the variable frequency module 213 may obtain predicted train position information based on pre-stored train running information, or receive wirelessly received real-time train position information from the mobile station apparatus 120. Furthermore, the variable frequency module 213 wirelessly transmits the non-safety-related train running information output from the non-safety-related train running information providing unit 211 by using the detected variable frequency.

Data transmitted at a variable frequency is not in a frequency domain used as a train dedicated frequency, and thus it is impossible to guarantee the quality of data (for example, a data transfer rate, an assigned frequency bandwidth, etc.) transmitted according to positions, time, and ambient conditions. However, the data is not information that is necessary for running a train, and thus does not directly affect the safe running of the train.

Although not shown, the safety-related train running information providing unit 221 combines information input from a user through a manipulator and information received by a wired/wireless communicator to generate and output safety-related train running information. Then, the fixed frequency module 222 transmits the safety-related train running information at a predetermined fixed frequency.

Figure 3:
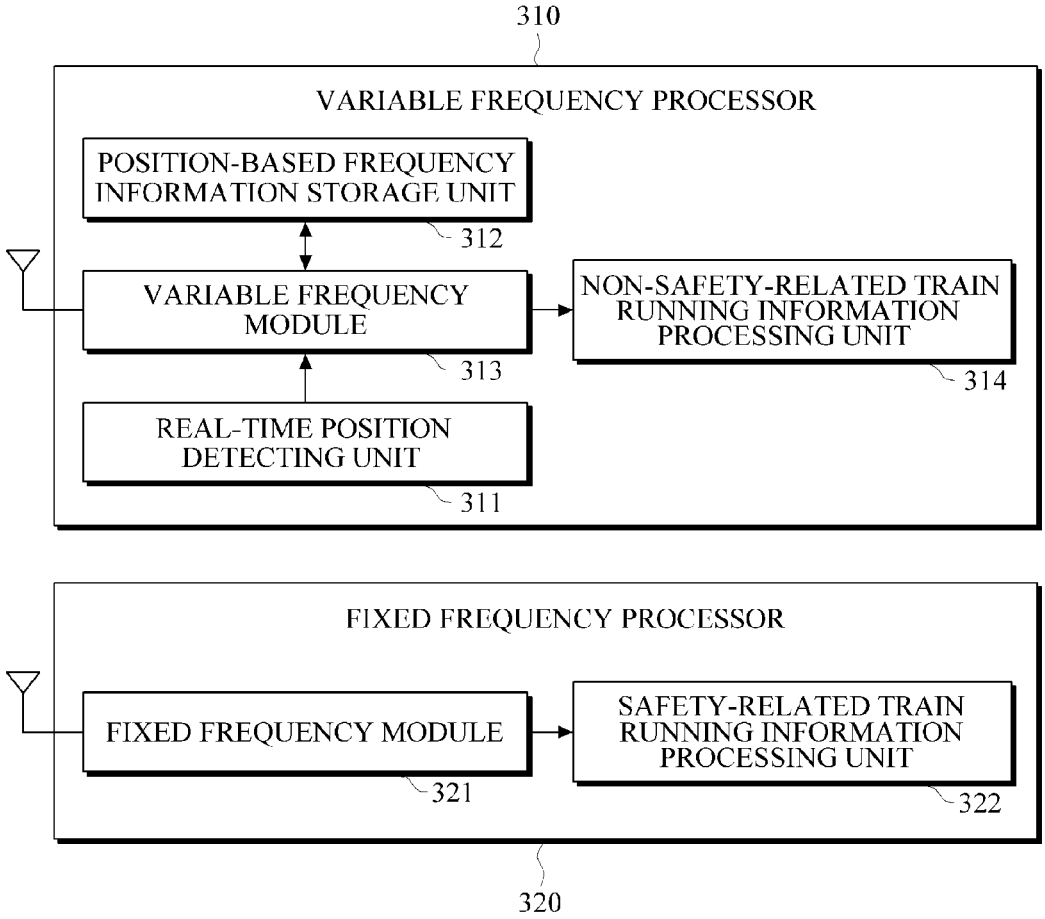
FIG. 3 is a block diagram illustrating an internal configuration of a mobile station apparatus for railway wireless communication according to a first embodiment of the present invention.

FIG. 3 is a block diagram illustrating an internal configuration of a mobile station apparatus for railway wireless communication according to a first embodiment of the present invention.

Referring to FIG. 3, a variable frequency processor 310 includes a real-time position detecting unit 311, a position-based frequency information storage unit 312, a variable frequency module 313, and a non-safety-related train running information processing unit 314.

The real-time position detecting unit 311 receives real-time position information from the position information providing apparatus 130 of FIG. 1, and transmits the received position information to the variable frequency module 313.

The position-based frequency information storage unit 312 stores a predetermined available variable frequency mapping table according to positions. Here, a representative example of the available variable frequency is a white space frequency that is not used in a specific zone but has been licensed as a broadcasting frequency.

The variable frequency module 313 receives real-time position information from the real-time position detecting unit 311, and detects a variable frequency available at the received real-time position from the position-based frequency information storage unit 312. Also, according to an embodiment of the present invention, the base station 110 may transmit the real-time position information. In this case, the real-time position information is required to be transmitted together with train identification information. Furthermore, the variable frequency module 313 wirelessly receives and outputs non-safety-related train running information at an available frequency.

The non-safety-related train running information processing unit 314 processes the non-safety-related train running information from the variable frequency module 313. Although not shown, the non-safety-related train running information processing unit 314 may process the non-safety-related train running information to be output through a display or speaker of a passenger car or control room inside a train according to characteristics of the non-safety-related train running information.

A fixed frequency processor 320 includes a fixed frequency module 321 and a safety-related train running information processing unit 322.

The fixed frequency module 321 receives safety-related train running information at a predetermined fixed frequency. The safety-related train running information processing unit 322 receives and processes the safety-related train running information received by the fixed frequency module 321. Although not shown, the safety-related train running information processing unit 322 may process the safety-related train running information to be output through a display or speaker of a passenger car or control room inside a train according to characteristics of the safety-related train running information.

Figure 4:
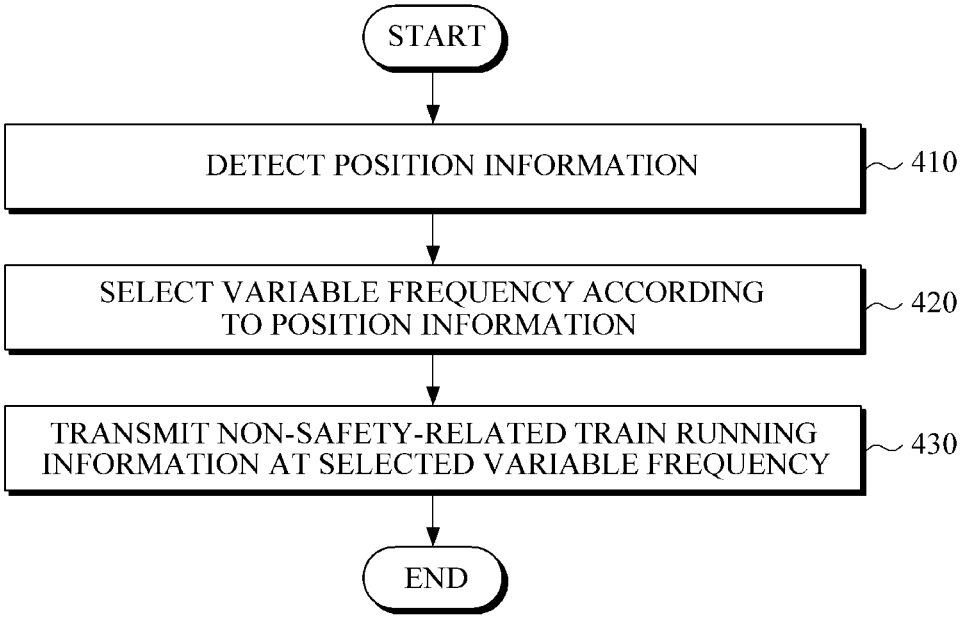
FIG. 4 is a flowchart for describing a frequency control method for railway wireless communication of a base station apparatus according to a first embodiment of the present invention.

FIG. 4 is a flowchart for describing a frequency control method for railway wireless communication of a base station apparatus according to a first embodiment of the present invention.

Referring to FIG. 4, the base station 110 obtains the position information of a specific train in operation 410. In a method of obtaining the position information of the specific train, the base station 110 may obtain predicted train position information according to pre-stored train running information, or receive wirelessly received real-time train position information from the mobile station apparatus 120.

The base station 110 selects a variable frequency available at the obtained train position in operation 420. The base station 110 obtains a mapped variable frequency from the available variable frequency information table according to the position of the specific train. Here, a representative example of the available variable frequency is a white space frequency that is not used in a specific zone but has been licensed as a broadcasting frequency. Furthermore, the base station 110 wirelessly transmits non-safety-related train running information at the selected variable frequency in operation 430.

Although not shown, the base station 110 transmits safety-related train running information at a predetermined fixed frequency.

Figure 5:
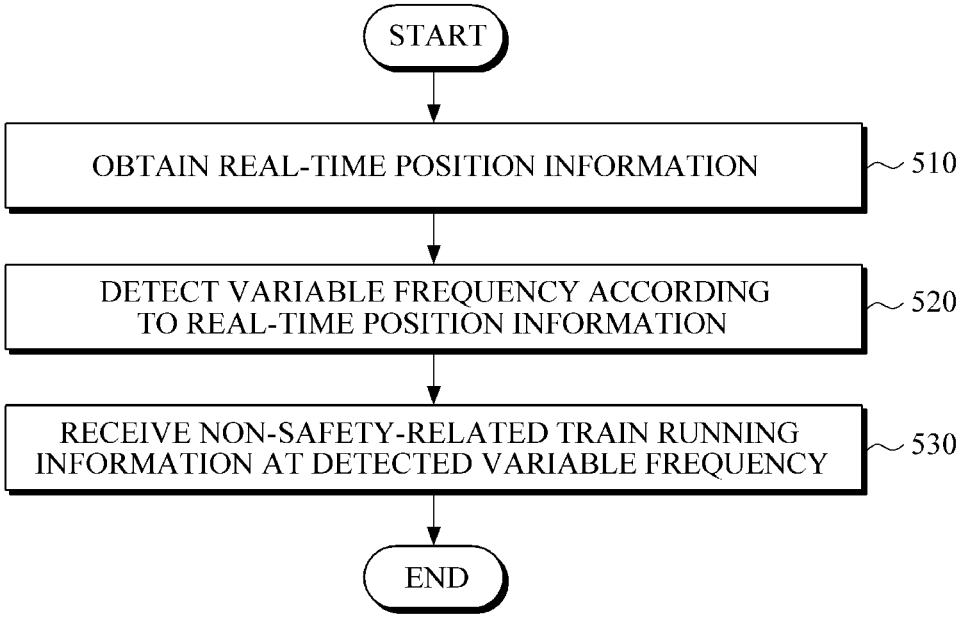
FIG. 5 is a flowchart for describing a frequency control method for railway wireless communication of a mobile station apparatus according to a first embodiment of the present invention.

FIG. 5 is a flowchart for describing a frequency control method for railway wireless communication of a mobile station apparatus according to a first embodiment of the present invention.

Referring to FIG. 5, the base station 120 receives real-time position information from the position information providing apparatus 130 of FIG. 1 in operation 510. Also, according to an embodiment of the present invention, the base station 110 may transmit the real-time position information. In this case, the real-time position information is required to be transmitted together with train identification information.

The mobile station apparatus 120 detects a variable frequency available at the obtained real-time position in operation 520. The variable frequency is detected from a predetermined available variable frequency information table according to a pre-stored position. Here, a representative example of the available variable frequency is a white space frequency that is not used in a specific zone but has been licensed as a broadcasting frequency.

The mobile station apparatus 120 wirelessly receives non-safety-related train running information at an available frequency in operation 530. Although not shown, the mobile station apparatus 120 transmits safety-related train running information at a predetermined fixed frequency.

Figure 6:
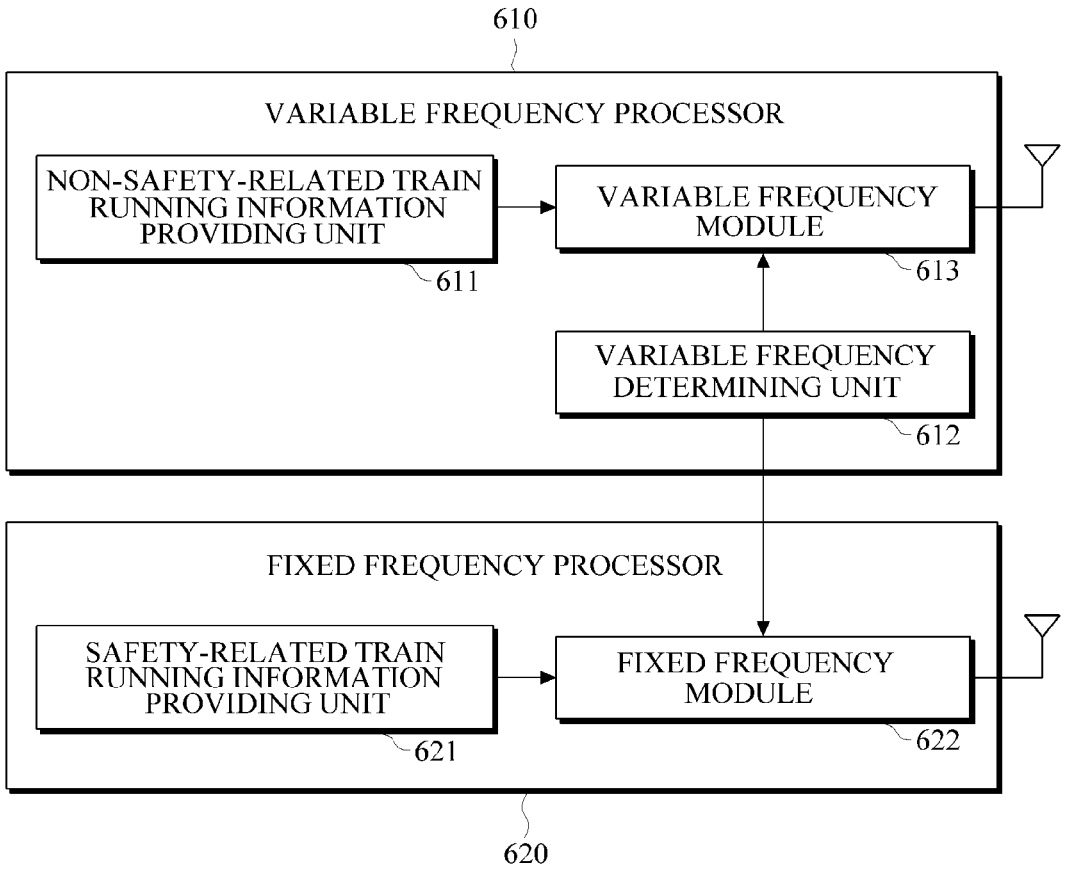
FIG. 6 is a block diagram illustrating an internal configuration of a base station apparatus for railway wireless communication according to a second embodiment of the present invention.

FIG. 6 is a block diagram illustrating an internal configuration of a base station apparatus for railway wireless communication according to a second embodiment of the present invention.

Referring to FIG. 6, a variable frequency processor 610 includes a non-safety-related train running information providing unit 611, a variable frequency determining unit 612, and a variable frequency module 613. The fixed frequency processor 620 includes a safety-related train running information providing unit 621 and a fixed frequency module 622.

Although not shown, the non-safety-related train running information providing unit 611 combines information input from a user through a manipulator and information received by a wired/wireless communicator to generate and output non-safety-related train running information.

The variable frequency determining unit 612 personally determines the assignment of a variable frequency according to various factors at a specific time without dependence on a specific position. The variable frequency determining unit 612 monitors a frequency available at a current position in real time. The variable frequency determining unit 612 outputs the determined variable frequency information to the variable frequency module 613 and the fixed frequency module 622. That is, the variable frequency determining unit 612 enables the mobile station apparatus 120 to obtain the variable frequency information at a fixed frequency. Here, the variable frequency information may include a specific band, a bandwidth, and a transmission scheme.

The variable frequency module 613 wirelessly transmits non-safety-related train running information output from the non-safety-related train running information providing unit 611 at the variable frequency that is output by the variable frequency determining unit 612. Data transmitted at the variable frequency is not in a frequency domain used as a train dedicated frequency, and thus it is impossible to guarantee the quality of data (for example, a data transfer rate, an assigned frequency bandwidth, etc.) transmitted according to positions, time, and ambient conditions. However, the data is not information that is necessary for running a train, and thus does not directly affect the safe running of the train.

Although not shown, the safety-related train running information providing unit 621 combines information input from a user through a manipulator and information received by a wired/wireless communicator to generate and output safety-related train running information. Then, the fixed frequency module 622 transmits the safety-related train running information at a predetermined fixed frequency, and transmits variable frequency information, transmitted from the variable frequency determining unit 612, at the fixed frequency.

Figure 7:
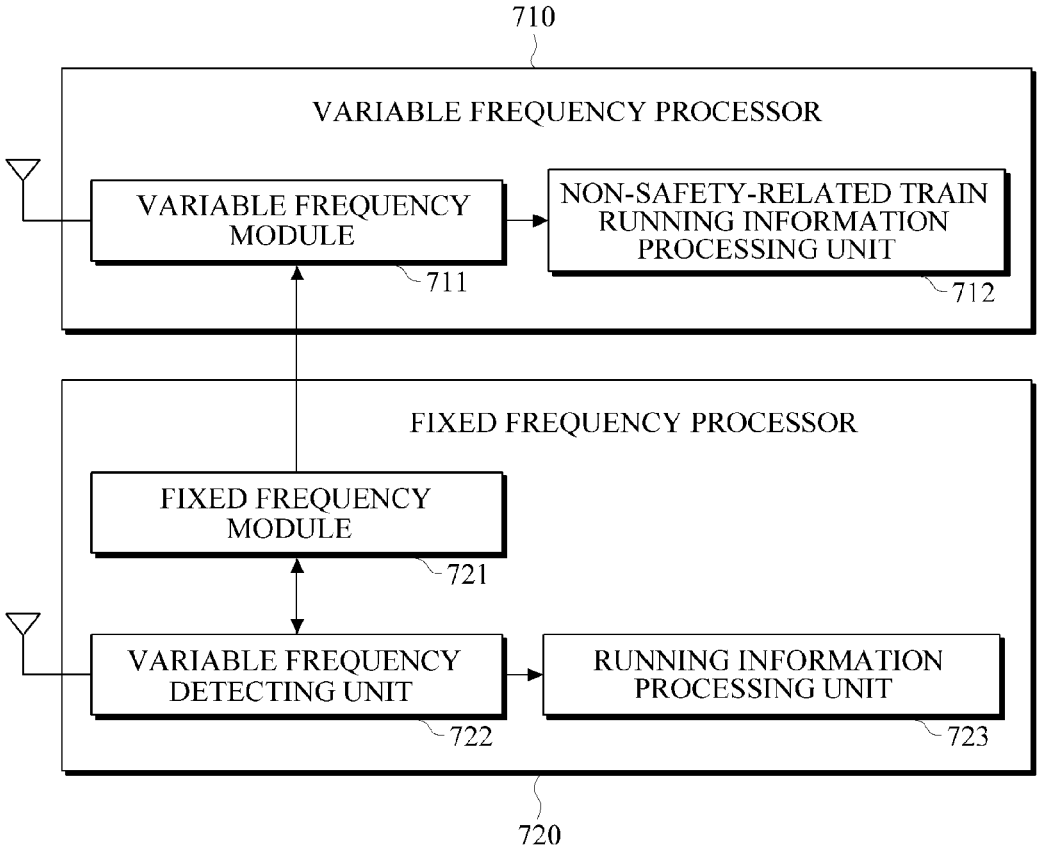
FIG. 7 is a block diagram illustrating an internal configuration of a mobile station apparatus for railway wireless communication according to a second embodiment of the present invention.

FIG. 7 is a block diagram illustrating an internal configuration of a mobile station apparatus for railway wireless communication according to a second embodiment of the present invention.

Referring to FIG. 7, a variable frequency processor 710 includes a variable frequency module 711 and a non-safety-related train running information processing unit 712.

The variable frequency module 711 wirelessly receives and outputs non-safety-related train running information according to variable frequency information received from a variable frequency detecting unit 722. The non-safety-related train running information processing unit 712 processes the non-safety-related train running information output from the variable frequency module 711.

Although not shown, the non-safety-related train running information processing unit 712 may process the non-safety-related train running information to be output through a display or speaker of a passenger car or control room inside a train according to characteristics of the non-safety-related train running information.

A fixed frequency processor 720 includes a fixed frequency module 721, the variable frequency detecting unit 722, and a safety-related train running information processing unit 723.

The fixed frequency module 721 receives safety-related train running information and variable frequency information at a predetermined fixed frequency. The variable frequency detecting unit 722 detects variable frequency information received by the fixed frequency module 721 and outputs the variable frequency information to the variable frequency module 711. The safety-related train running information processing unit 723 receives and processes the safety-related train running information received by the fixed frequency module 721. Although not shown, the safety-related train running information processing unit 723 may process the safety-related train running information to be output through a display or speaker of a passenger car or control room inside a train according to characteristics of the safety-related train running information.

Figure 8:
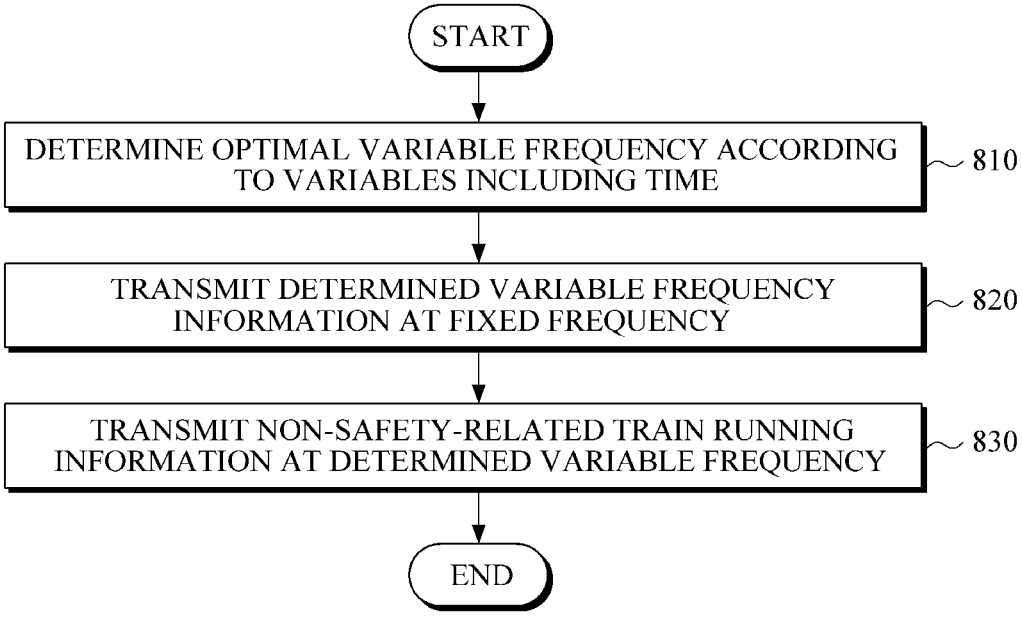
FIG. 8 is a flowchart for describing a frequency control method for railway wireless communication of a base station apparatus according to a second embodiment of the present invention.

FIG. 8 is a flowchart for describing a frequency control method for railway wireless communication of a base station apparatus according to a second embodiment of the present invention.

Referring to FIG. 8, the base station 110 determines a variable frequency available in a specific train according to various variables including time in operation 810. The base station 110 personally determines the assignment of a variable frequency according to various factors at a specific time without dependence on a specific position. That is, the base station 110 monitors a frequency available at a current position in real time, and determines available variable frequency information. Here, the variable frequency information may include a specific band, a bandwidth, and a transmission scheme.

The base station 110 outputs the determined variable frequency information to the mobile station apparatus 120 at a fixed frequency in operation 820. That is, the base station 110 enables the mobile station apparatus 120 to obtain the variable frequency information at the fixed frequency.

The base station 110 wirelessly transmits non-safety-related train running information at the determined variable frequency in operation 830. Data transmitted at the variable frequency is not in a frequency domain used as a train dedicated frequency, and thus, it is impossible to guarantee the quality of data (for example, a data transfer rate, an assigned frequency bandwidth, etc.) transmitted according to positions, time, and ambient conditions. However, the data is not information that is necessary for running a train, and thus does not directly affect the safe running of the train. Although not shown, the base station 110 transmits safety-related train running information at a predetermined fixed frequency. Also, although not shown, the base station 110 may process the train running information to be output through a display or speaker of a passenger car or control room inside a train according to characteristics of the train running information.

Figure 9:
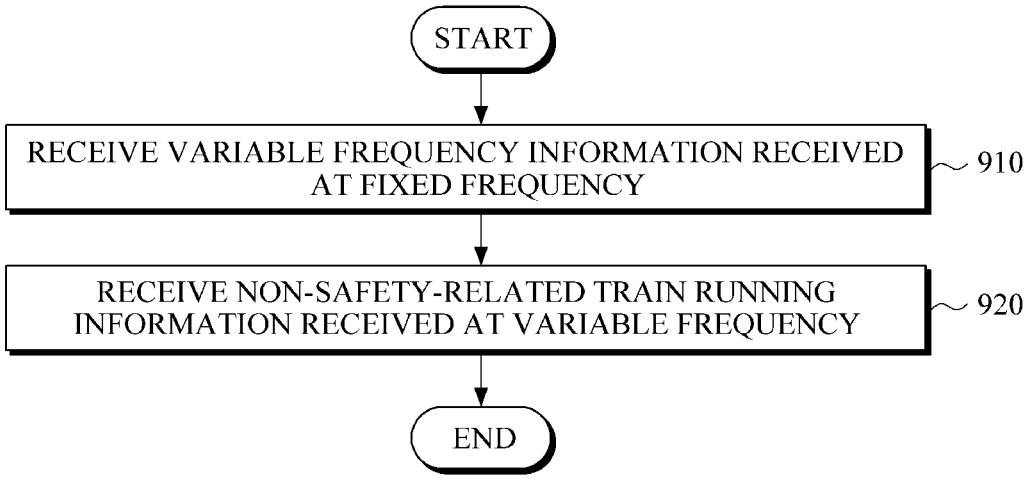
FIG. 9 is a flowchart for describing a frequency control method for railway wireless communication of a mobile station apparatus according to a second embodiment of the present invention.

FIG. 9 is a flowchart for describing a frequency control method for railway wireless communication of a mobile station apparatus according to a second embodiment of the present invention.

Referring to FIG. 9, the mobile station apparatus 120 receives variable frequency information at a fixed frequency in operation 910. The mobile station apparatus 120 wirelessly receives non-safety-related train running information at an available frequency on the basis of the received variable frequency information in operation 920. Although not shown, the mobile station apparatus 120 receives safety-related train running information at a predetermined fixed frequency. Also, although not shown, the base station 110 may process the train running information to be output through a display or speaker of a passenger car or control room inside a train according to characteristics of the train running information.

In the present invention, a dedicated frequency is utilized to transmit only important information that is essential for the safe running of trains, whereas a variable frequency that varies according to a current position and ambient conditions is utilized to transmit a variety of large-scale railway service information that is irrelevant to the safe running of trains. Thus, there present invention can create conditions whereby various railway services can be rendered using only a narrow railway dedicated frequency band.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A frequency control apparatus for railway wireless communication, comprising:

a variable frequency processor configured to select an available variable frequency and wirelessly transmit non-safety-related train running information of a train to a mobile station in the train at the selected variable frequency; and a fixed frequency processor configured to wirelessly transmit safety-related train running information to the mobile station at a predetermined fixed frequency.

2. The frequency control apparatus of claim 1, wherein the variable frequency processor comprises:

a non-safety-related train running information providing unit configured to provide the non-safety-related train running information;

a position-based frequency information storage unit configured to store an available variable frequency information table according to a train position; and a variable frequency module configured to obtain position information of the train, detect a variable frequency available at the obtained train position from the position-based frequency information storage unit, and wirelessly transmit non-safety-related train running information output from the non-safety-related train running information providing unit according to the detected variable frequency.

3. The frequency control apparatus of claim 1, wherein the available variable frequency is a white space frequency that is not used in a specific zone but has been licensed as a broadcasting frequency.

4. The frequency control apparatus of claim 1, wherein the fixed frequency module comprises:

a safety-related train running information providing unit configured to generate and output the safety-related train running information; and a fixed frequency module configured to transmit the safety-related train running information at a predetermined fixed frequency.

5. The frequency control apparatus of claim 1, wherein the variable frequency processor comprises:

a non-safety-related train running information providing unit configured to provide the non-safety-related train running information;

a variable frequency determining unit configured to determine a frequency available at a specific time; and a variable frequency module configured to wirelessly transmit the non-safety-related train running information, output from the non-safety-related train running information providing unit, at the variable frequency determined by the variable frequency determining unit.

6. The frequency control apparatus of claim 5, wherein the variable frequency information comprises a specific band, a bandwidth, and a transmission scheme.

7. The frequency control apparatus of claim 5, wherein the fixed frequency processor comprises:

a safety-related train running information providing unit configured to generate and output the safety-related train running information; and a fixed frequency module configured to transmit the safety-related train running information and variable frequency information determined by the variable frequency determining unit at the predetermined fixed frequency.

8. A frequency control apparatus for railway wireless communication, comprising:

a variable frequency processor configured to select an available variable frequency and wirelessly receive non-safety-related train running information from a base station at the selected variable frequency; and a fixed frequency processor configured to wirelessly receive safety-related train running information at a predetermined fixed frequency.

9. The frequency control apparatus of claim 8, wherein the variable frequency processor comprises:

a real-time position detecting unit configured to receive real-time position information from one or more position information providing apparatuses disposed at certain intervals on a railroad on which a train moves;

a frequency information storage unit configured to store a predetermined available variable frequency mapping table according to positions; and a variable frequency module configured to receive real-time position information from the real-time position detecting unit, detect a variable frequency available at the received real-time position from the frequency information storage unit, and wirelessly receive and output non-safety-related train running information at an available frequency.

10. The frequency control apparatus of claim 8, wherein the fixed frequency processor comprises:

a fixed frequency module configured to receive the safety-related train running information at a predetermined fixed frequency; and a safety-related train running information processing unit configured to receive and process the safety-related train running information received by the fixed frequency module.

11. The frequency control apparatus of claim 8, wherein the fixed frequency processor comprises:

a fixed frequency module configured to receive safety-related train running information and variable frequency information at a predetermined fixed frequency;

a variable frequency detecting unit configured to detect and output the variable frequency information received by the fixed frequency module to the variable frequency processor; and a fixed frequency module configured to receive and process the safety-related train running information received by the fixed frequency module.

12. The frequency control apparatus of claim 11, wherein the fixed frequency processor comprises:

a variable frequency module configured to wirelessly receive non-safety-related train running information at the variable frequency received from the variable frequency detecting unit; and a non-safety-related train running information processing unit configured to process the non-safety-related train running information output from the variable frequency module.

13. A frequency control method for railway wireless communication, comprising:

selecting an available variable frequency and wirelessly transmitting non-safety-related train running information of a train to a mobile station in the train at the selected variable frequency; and wirelessly transmitting safety-related train running information to the mobile station at a predetermined fixed frequency.

14. The frequency control method of claim 13, wherein the wirelessly transmitting of the non-safety-related train running information comprises:

obtaining position information of the train;

selecting a variable frequency available at the obtained train position from the position-based frequency information storage unit; and wirelessly transmitting non-safety-related train running information at the selected variable frequency.

15. The frequency control method of claim 14, wherein the wirelessly transmitting of the non-safety-related train running information comprises:

determining a variable frequency available in the train with time; and wirelessly transmitting non-safety-related train running information at the determined variable frequency.

16. The frequency control method of claim 15, wherein the wirelessly transmitting of the safety-related train running information comprises transmitting both the determined variable frequency information and the safety-related train running information at a fixed frequency.

17. A frequency control apparatus for railway wireless communication, comprising:

wirelessly receiving safety-related train running information from a base station at a predetermined fixed frequency; and selecting an available variable frequency and wirelessly receiving non-safety-related train running information at the selected variable frequency.

18. The frequency control method of claim 17, wherein the wirelessly transmitting of the non-safety-related train running information comprises:

receiving real-time position information from one or more position information providing apparatuses disposed at certain intervals on a railroad;

detecting a variable frequency available at the obtained real-time position; and wirelessly receiving and outputting the non-safety-related train running information at the available frequency.

19. The frequency control method of claim 17, wherein the wirelessly transmitting of the safety-related train running information comprises receiving both variable frequency information and the safety-related train running information at the fixed frequency.

20. The frequency control method of claim 19, wherein the wirelessly transmitting of the non-safety-related train running information comprises wirelessly receiving non-safety-related train running information at a corresponding variable frequency according to variable frequency information which is received at the fixed frequency.

* * * * *